US006208592B1

(12) United States Patent
Turner

(10) Patent No.: US 6,208,592 B1
(45) Date of Patent: Mar. 27, 2001

(54) CLOCK WITH NOVELTY HANDS

(76) Inventor: Russell S. Turner, 5640 Wayne Milford Rd., Hamilton, OH (US) 45013

( * ) Notice: Subject to any disclaimer, the term of this patent is extended or adjusted under 35 U.S.C. 154(b) by 0 days.

(21) Appl. No.: 09/203,890

(22) Filed: Dec. 2, 1998

(51) Int. Cl.[7] ..... G04B 19/00; G04B 19/04; G04B 25/00

(52) U.S. Cl. ..... 368/76; 368/80; 368/223; 368/232

(58) Field of Search ..... 368/76, 80, 223, 368/228, 232, 238, 285

(56) References Cited

U.S. PATENT DOCUMENTS

| | | | | |
|---|---|---|---|---|
| Re. 30,987 | * | 6/1982 | Jones | 368/76 |
| 4,163,362 | | 8/1979 | Ferina | 58/126 R |
| 4,421,421 | | 12/1983 | Bradt | 368/229 |
| 4,601,585 | * | 7/1986 | Farley | 368/80 |
| 4,671,669 | | 6/1987 | Graves | 368/17 |
| 4,712,924 | * | 12/1987 | Agostini | 368/76 |
| 4,885,729 | * | 12/1989 | Lee | 368/76 |
| 5,033,965 | | 7/1991 | Chiu et al. | 434/131 |
| 5,280,461 | | 1/1994 | Belik | 368/228 |

* cited by examiner

*Primary Examiner*—Vit Miska
(74) *Attorney, Agent, or Firm*—Richard L Miller, P.E.

(57) ABSTRACT

A clock with novelty hands that exhibit a different configuration at each time change when viewed from a same elevation, and by memorizing the different configurations, a viewer can tell time without having to consult its clock face. The clock includes a base, a clock face, a specifically configured second hand rotatably mounted to the base, a second apparatus, a specifically configured minute hand, minute apparatus, a specifically configured hour hand, hour apparatus, and a bell jar. The clock face disposed on the base. The specifically configured second hand is rotatably mounted to the base. The second apparatus rotatably mounts the second hand to the base. The specifically configured minute hand is rotatably mounted to the base. The minute apparatus rotatably mounts the minute hand to the base. The specifically configured hour hand is rotatably mounted to the base.

30 Claims, 4 Drawing Sheets

FIG.3
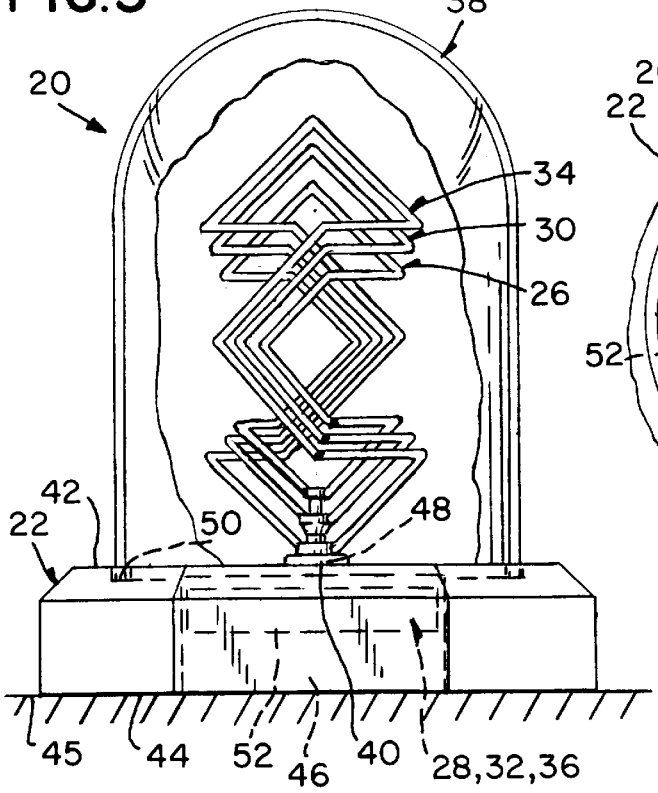
FIG.4 (3:00PM)
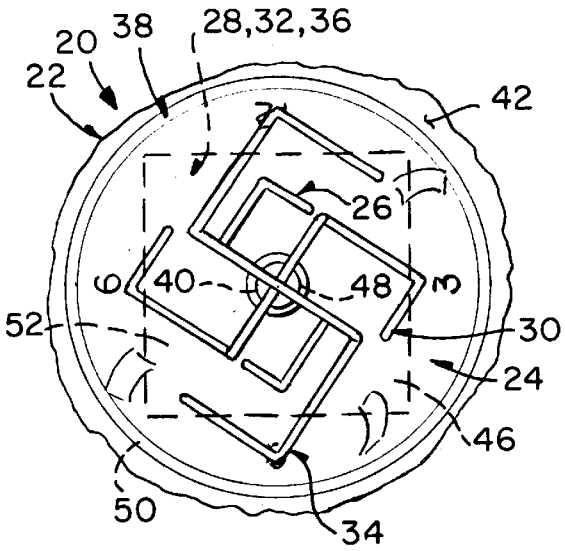
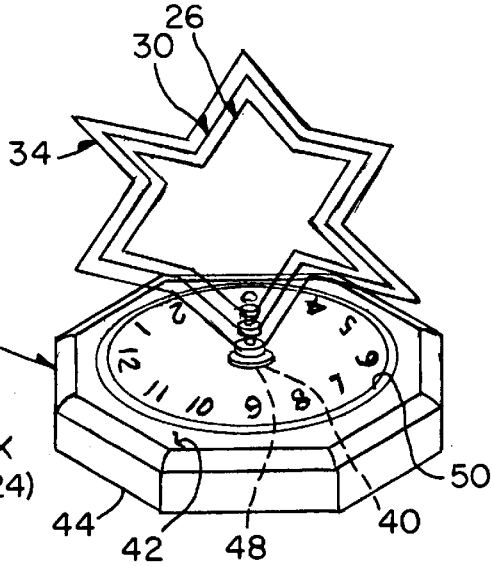
FIG.6
FIG.5
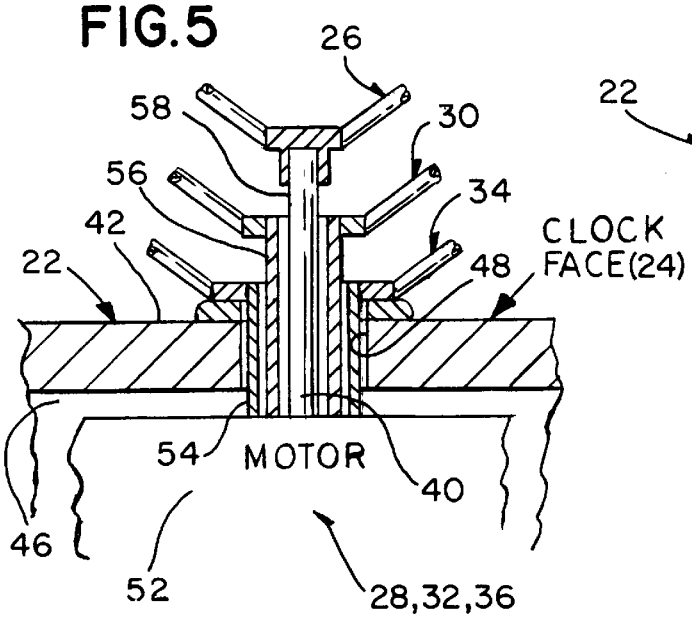

CLOCK WITH NOVELTY HANDS

BACKGROUND OF THE INVENTION

1. Field of the Invention

The present invention relates to a clock. More particularly, the present invention relates to a clock with a clock face and novelty hands that exhibit a different configuration at each time change when viewed from a same side, and by memorizing the different configurations, a viewer can tell time without having to consult the clock face.

2. Description of the Prior Art

Numerous innovations for clocks have been provided in the prior art that will be described. Even though these innovations may be suitable for the specific individual purposes to which they address, however, they differ from the present invention.

A FIRST EXAMPLE, U.S. Pat. No. 4,163,362 to Ferina teaches a new and improved means for visually displaying the time of day comprising generally asymmetrical three-dimensional bodies mounted for rotation about a common axis. A base structure houses a standard clock mechanism including three concentric drive shafts, corresponding to the "hours" "minutes" and "seconds" time measurements, respectively. The concentric drive shafts project from the top of the base structure and lie along a common axis of rotation. An irregularly shaped shaft support is attached to the base structure and extends upwardly in an appropriate contour whereby the outer end thereof intersects the common axis of rotation. The seconds drive shaft extends from the top of the base structure and is rotatably supported in a bearing arranged in the shaft support at the point of intersection with the common axis. The hours indicator comprises a first asymmetrical three-dimensional body. The hours drive shaft is in a driving engagement with the hours indicator to rotate the hours indicator 360 degrees about the common axis once every 12 or 24 hours. The minutes indicator comprises a second asymmetrical three-dimensional body. The minutes drive shaft extend through the hours drive shaft and is in a driving engagement with the minutes indicator and rotates the minutes indicator about the common axis once every 60 minutes. The seconds indicator comprises a disc fixedly secured to the second drive shaft, which rotates the disc once every 60 seconds. The seconds drive shaft extends through a moving fit with each of the hours and minutes indicators to the bearing in the shaft support. The relative positions between the rotating asymmetrical bodies and the shaft support indicates the hour and minute of the day.

A SECOND EXAMPLE, U.S. Pat. No. 4,421,421 to Bradt teaches a time keeping clock that includes a kinetic clock sculpture arrangement in which the clock comprises the usual minute and hour hands journalled for rotation in clockwise directions about a common axis, and a time keeping mechanism for driving said minute and hour hands to keep time, with the clock including a kinetic sculpture arrangement comprising a relatively large, medially located, kinetic sculpture drive gear wheel that is vertically disposed and has it axis of rotation disposed horizontally and paralleling that of the common axis of the clock minute and hour hands, one or more driven gear wheels that are of a diameter which is relatively small as compared to that of the drive wheel gear, and which are disposed in coupled rotation to the drive gear wheel at spaced locations thereabout, with several of said driven gear wheels each driving a separate crank about a horizontal axis, and a drive gear wheel actuated mechanical linkage of miniature stick figure form articulated to each of the said cranks, with each of the said linkages being disposed in upright relation adjacent to and at the level of the crank to which same is articulated, with the stick figure linkages being contoured, anchored, and articulated in place for simulating front to back human like motion involving a rotation of the cranks, suggestive that they are assisting in driving the time keeping mechanism, with the kinetic sculpture also including drive gear wheel actuated cam arm and rocking beam arrangements to which similar stick figure linkages located at various positions about the clock are articulated for the same purpose.

A THIRD EXAMPLE, U.S. Pat. No. 4,671,669 to Graves teaches a novelty clock wherein a spherical representation of the earth revolves about a stationary depiction of the sun at the face of the clock as would a second hand. While revolving about the sun, the earth also rotates upon its own axis which is angularly disposed to the straight line between sun and earth. The earth's motion, in conjunction with depictions of other planets of the solar system, provides an appealing and realistic visual effect. The motion of the earth is achieved by a mechanism driven by rotation of the shaft which would otherwise drive the second hand of the clock.

A FOURTH EXAMPLE, U.S. Pat. No. 5,033,965 to Chiu et al. teaches a three dimensional globe utilizing a transparent spherical globe having geographical areas outlined thereon with fluorescent paint combined with an external black light to illuminate and render uniquely observable all of the outline of the geographical area. A clock with spherical members mounted at the ends of the hands thereon are associated with the globe to simulate the movement of planets in relation to the globe with the balls being relatively small and also fluorescent colored for effective illumination by the black light. The globe provides a unique, attractive and informative globe utilizing high technology and effective structure for movement of the globe in a rotational manner about a substantially vertical axis.

A FIFTH EXAMPLE, U.S. Pat. No. 5,280,461 to Belik teaches a timepiece in the form of a body having a face which displays a sinusoidal path of multiples of twelve wavelengths within a circular periphery, and concentric rings on the face which intersect the path. An arm rotates about the center of the face a rate of one revolution per every twelve hours. A time-indicating pointer, mounted for guided longitudinal movement with respect to the arm, reciprocates with respect to the arm at one cycle per hour. The combined rotation of the arm and reciprocation of the pointer cause the pointer to follow the sinusoidal path, such that the pointer indicates hours by its circumferential position relative to the crests of the wavelengths and indicates minutes by its radial position relative to the concentric rings.

It is apparent that numerous innovations for clocks have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a clock with novelty hands that avoids the disadvantages of the prior art.

ANOTHER OBJECT of the present invention is to provide a clock with novelty hands that is simple and inexpensive to manufacture.

STILL ANOTHER OBJECT of the present invention is to provide a clock with novelty hands that is simple to use.

BRIEFLY STATED, YET ANOTHER OBJECT of the present invention is to provide a clock with novelty hands that exhibit a different configuration at each time change when viewed from a same side, and by memorizing the different configurations, a viewer can tell time without having to consult its clock face. The clock includes a base, a clock face, a specifically configured second hand rotatably mounted to the base, a second apparatus, a specifically configured minute hand, minute apparatus, a specifically configured hour hand, hour apparatus, and a bell jar. The clock face disposed on the base. The specifically configured second hand is rotatably mounted to the base. The second apparatus rotatably mounts the second hand to the base. The specifically configured minute hand is rotatably mounted to the base. The minute apparatus rotatably mounts the minute hand to the base, The specifically configured hour hand is rotatably mounted to the base. The hour apparatus rotatably mounts the hour hand to the base. The bell jar is replaceably mounted to the base and encapsulates the clock face, the second hand, the minute hand, and the hour hand.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 3 is a diagrammatic front elevational view taken generally in the direction of arrow 3 in FIG. 1;

FIG. 4 is a diagrammatic top plan view of the present invention, with the hands indicating three o'clock;

FIG. 5 is an enlarged diagrammatic cross sectional view, with parts broken away, illustrating the hour apparatus, the minute apparatus, and the second apparatus;

FIG. 6 is a diagrammatic perspective view of the present invention with the bell jar removed;

LIST OF REFERENCE NUMERALS UTILIZED IN THE DRAWING

Figure 1:
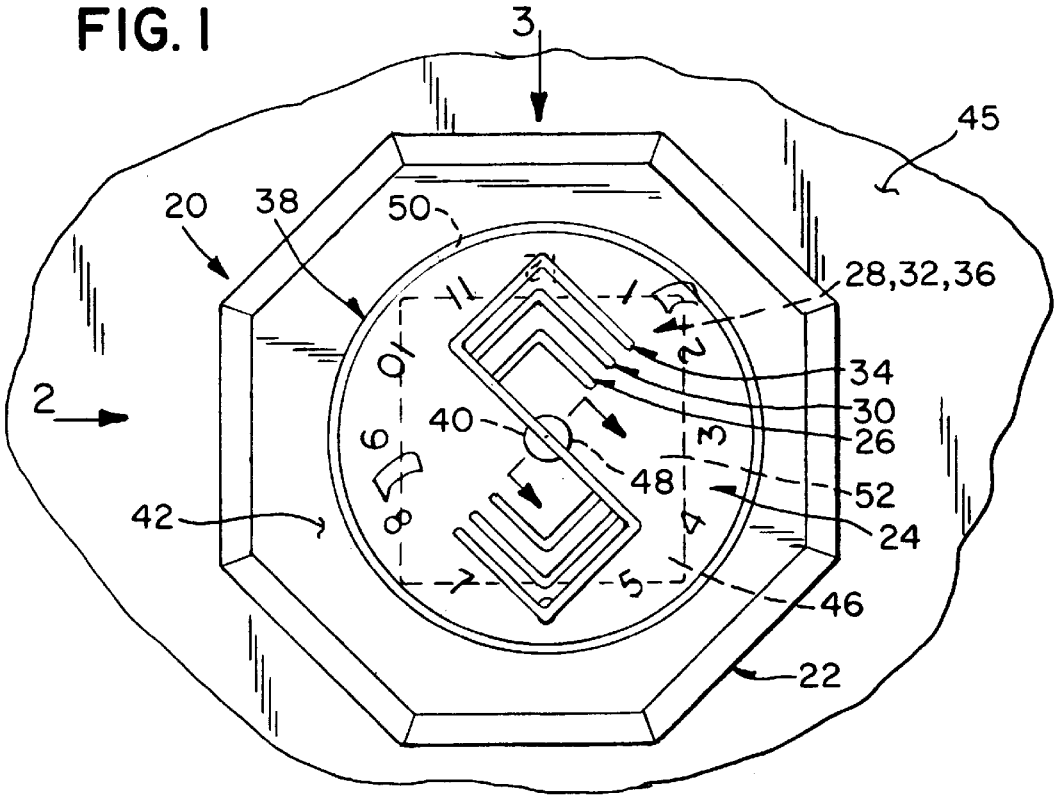
FIG. 1 is a diagrammatic top plan view of the present invention, with the hands indicating twelve o'clock.

20 clock with novelty hands of the present invention
22 base
24 clock face
26 second hand
28 second apparatus rotatably mounting second hand 26 to base 22
30 minute hand
32 minute apparatus rotatably mounting minute hand 30 to base 22
34 hour hand
36 hour apparatus rotatably mounting hour hand 34 to base 22
38 bell jar
40 center of base 22
42 uppermost face of base 22
44 lowermost face of base 22 for resting on horizontal surface 45
45 horizontal surface
46 chamber in lowermost face 44 of base 22
48 throughbore of chamber 46 in base 22
50 annular groove in uppermost face 42 of base 22
52 battery operated clock mechanism
54 hour arbor of hour apparatus 28
56 minute arbor of minute apparatus 32
58 second arbor of second apparatus 36
first portion of hour hand 34
62 second portion of hour hand 34
64 third portion of hour hand 34
66 fourth portion of hour hand 34
68 fifth portion of hour hand 34
70 sixth portion of hour hand 34
72 seventh portion of hour hand 34
74 eighth portion of hour hand 34
76 ninth portion of hour hand 34
78 tenth portion of hour hand 34
80 eleventh portion of hour hand 34
82 twelfth portion of hour hand 34

DETAILED DESCRIPTION OF THE PREFERRED EMBODIMENT

Referring now to the figures, in which like numerals indicate like parts, the clock with novelty hands of the present invention is shown generally at 20 having a face and novelty hands that exhibit a different configuration at each time change when viewed from a same elevation, and by memorizing the different configurations, a viewer can tell time without having to consult the face.

Figure 2:
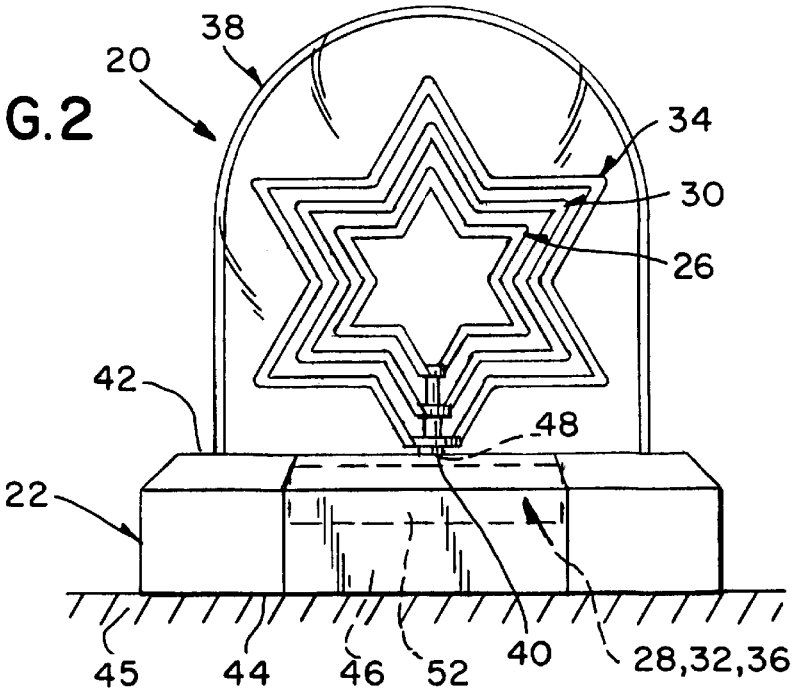
FIG. 2 is a diagrammatic side elevational view taken generally in the direction of arrow 2 in FIG. 1.

The general configuration of the clock with novelty hands 10 can best be seen in FIGS. 1–6, and as such, will be discussed with reference thereto.

The clock with novelty hands 20 comprises a base 22, a clock face 24 disposed on the base 22, a second hand 26 rotatably mounted to the base 22, second apparatus 28 rotatably mounting the second hand 26 to the base 22, a minute hand 30 rotatably mounted to the base 22, minute apparatus 32 rotatably mounting the minute hand 30 to the base 22, a hour hand 34 rotatably mounted to the base 22, hour apparatus 36 rotatably mounting the hour hand 34 to the base 22, and a bell jar 38 replaceable mounted to the base 22 and encapsulating the clock face 24, the second hand 26, the minute hand 30, and the hour hand 34.

The base 22 is low and octagonally-shaped in plan view, and has a center 40, an uppermost face 42 that flares dependingly to a lowermost face 44 that is below, and parallel to, the uppermost face 42 of the base 22 for resting on a horizontal surface 45.

The lowermost face 44 of the base 22 has a chamber 46 that opens therein and extends upwardly therefrom to slightly below the uppermost face 42 of the base 22, and terminates in a throughbore 48 that extends coaxially upwardly to, and opens into, the uppermost face 42 of the base 22, at the center 40 of the base 22.

The chamber 46 in the lowermost face 44 of the base 22 and the throughbore 48 of the chamber 46 in the base 22 house the second apparatus 28, the minute apparatus 32, and the hour apparatus 36.

The uppermost face 42 of the base 22 has an annular groove 50 that extends completely and concentrically therearound, and defines the clock face 24.

The clock face 24 is disposed concentrically on the uppermost face 42 of the base 22, and comprises the numerals 1–12 in a circular pattern therearound.

The second hand 26 is specifically-configured and extends rotatably axially upwardly from the throughbore 48 of the chamber 46 in the base 22, with the second apparatus 28 being operatively connected thereto.

The minute hand 30 is specifically-configured and extends rotatably axially upwardly from the throughbore 48 of the chamber 46 in the base 22, concentrically outward of the second hand 26, with the minute apparatus 32 being operatively connected thereto.

The hour hand 34 is specifically-configured and extends rotatably axially upwardly from the throughbore 48 of the chamber 46 in the base 22, concentrically outward of the minute hand 30, with the hour apparatus 36 being operatively connected thereto.

The bell jar 38 is transparent and replaceably engaged in the annular groove 50 in the uppermost face 42 of the base 22.

The second apparatus 28, the minute apparatus 32, and the hour apparatus 36 comprise a battery operated clock mechanism 52 that is housed in the chamber 46 in the base 22.

The hour apparatus 28 further comprises a hour arbor 54 that is operatively connected to the battery operated clock mechanism 52, and extends upwardly therefrom, through the throughbore 48 of the chamber 46 in the base 22, to the hour hand 34.

The minute apparatus 32 further comprises a minute arbor 56 that is operatively connected to the battery operated clock mechanism 52, and extends upwardly therefrom, through the throughbore 48 of the chamber 46 in the base 22, and concentrically through, so as not to interfere with, the hour arbor 54 of the second apparatus 28.

The second apparatus 36 further comprises a second arbor 58 that is operatively connected to the battery operated clock mechanism 52, and extends upwardly therefrom, through the throughbore 48 of the chamber 46 in the base 22, and concentrically through, so as not to interfere with, the minute arbor 56 of the minute apparatus 32.

Figure 7:
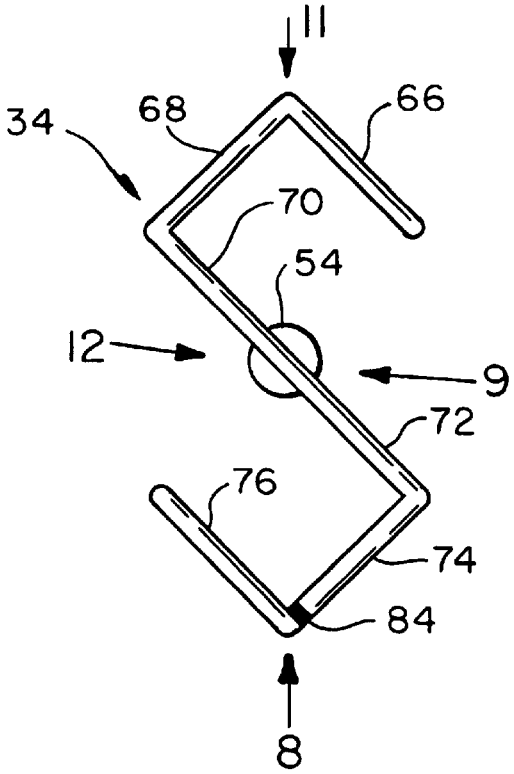
FIG. 7 is an enlarged diagrammatic top plan view of the hour hand.
Figure 8:
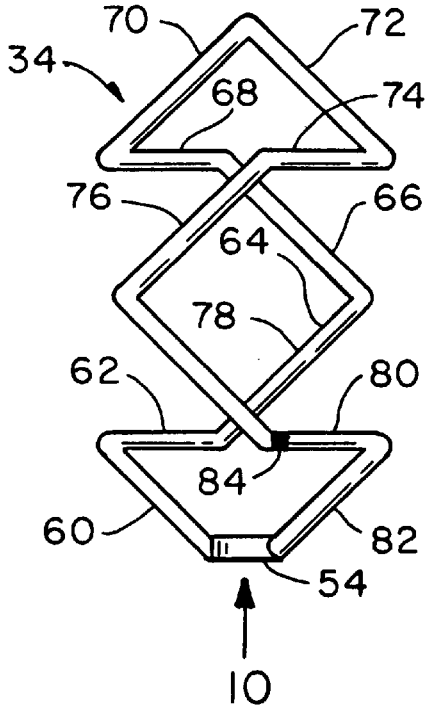
FIG. 8 is a diagrammatic side elevational view taken generally in the direction of arrow 8 in FIG. 7.
Figure 9:
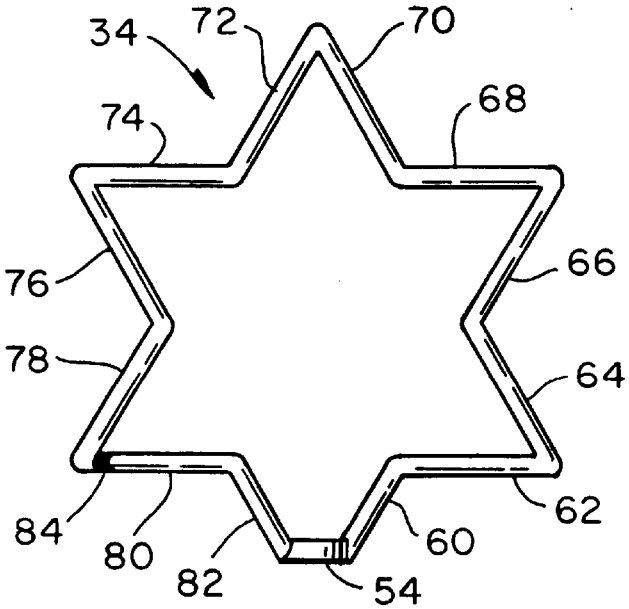
FIG. 9 is a diagrammatic front elevational view taken generally in the direction of arrow 9 in FIG. 7.
Figure 10:
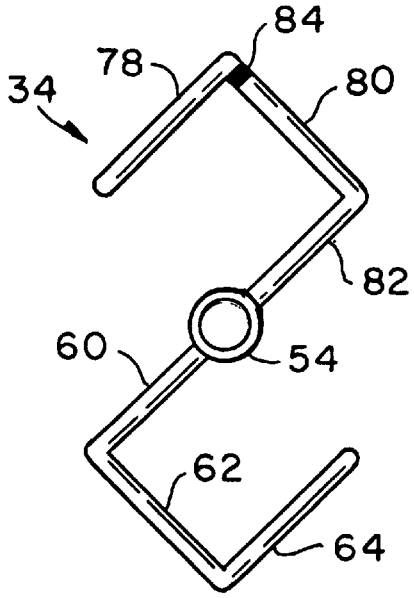
FIG. 10 is a diagrammatic bottom plane view taken generally in the direction of arrow 10 in FIG. 8.
Figure 11:
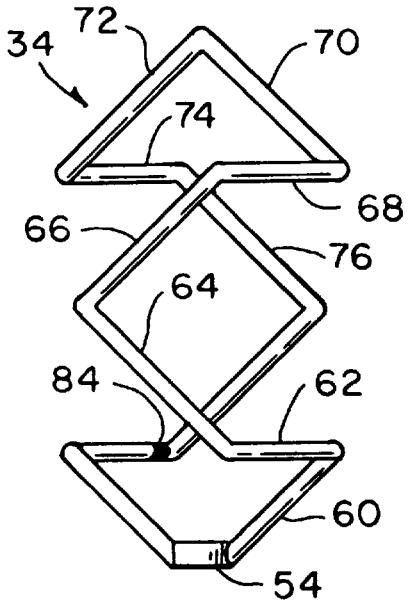
FIG. 11 is a diagrammatic side elevational view taken generally in the direction of arrow 11 in FIG. 7.
Figure 12:
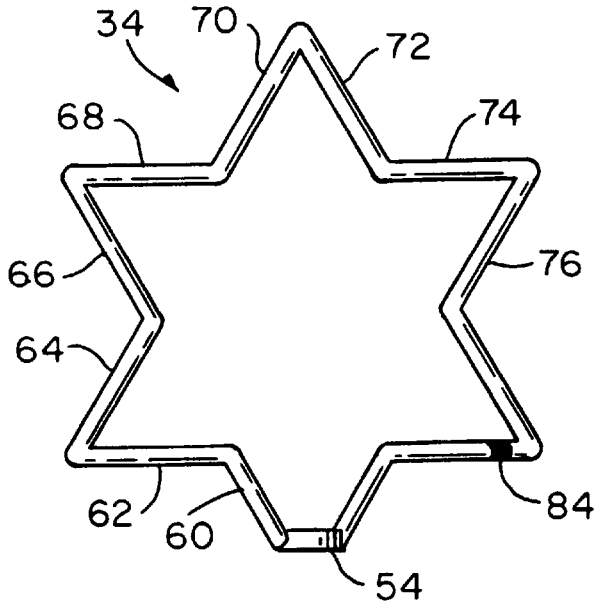
FIG. 12 is a diagrammatic rear elevational view taken generally in the direction of arrow 12 in FIG. 7.

The specific configuration of the hour hand 34 can best be seen in FIGS. 7–12, and as such, will be discussed with reference thereto.

The hour hand 34 is a slender and elongated rod bent into a specific configuration, that when viewed in plan, replicates a "swastika," which is defined in the Random House dictionary as:

> "a symbol or ornamental figure of ancient origin, consisting of a cross with arms of equal length, each arm having continuation at right angles in a uniformally clockwise or counterclockwise direction." [Emphasis added]

And when view at a specific elevation, replicates a "Star of David," which is defined in the Random House dictionary as:

> "a hexagram." [Emphasis added]

Wherein a "hexagram" is defined in the Random House dictionary as:

> "a six-pointed starlike figure formed of two equilateral triangles placed concentrically with each side of a triangle parallel to a side of the other and on opposite sides of the center." [Emphasis added]

The hour hand 34 comprises a first portion 60 that inclines outwardly upwardly, at a 45 degree angle, from the hour arbor 54 of the hour apparatus 28.

The hour hand 34 further comprises a second portion 62 that extends perpendicularly outwardly from the first portion 60 of the hour hand 34 and forms a first plane therewith.

The hour hand 34 further comprises a third portion 64 that inclines perpendicularly inwardly upwardly from the second portion 62 of the hour hand 34 and forms a second plane therewith.

The hour hand 34 further comprises a fourth portion 66 that inclines perpendicularly outwardly upwardly from the third portion 64 of the hour hand 34 and forms a third plane therewith.

The hour hand 34 further comprises a fifth portion 68 that extends perpendicularly inwardly from the fourth portion 66 of the hour hand 34 and forms a fourth plane therewith.

The hour hand 34 further comprises a sixth portion 70 that inclines perpendicularly inwardly upwardly from the fifth portion 68 of the hour hand 34 and forms a fifth plane therewith.

The hour hand 34 further comprises a seventh portion 72 that inclines perpendicularly outwardly downwardly from the sixth portion 70 of the hour hand 34 and forms a sixth plane therewith.

The hour hand 34 further comprises an eighth portion 74 that extends perpendicularly outwardly from the seventh portion 72 of the hour hand 34 and forms a seventh plane therewith.

The hour hand 34 further comprises a ninth portion 76 that inclines perpendicularly inwardly downwardly from the eighth portion 74 of the hour hand 34 and forms an eighth plane therewith.

The hour hand 34 further comprises a tenth portion 78 that inclines perpendicularly downwardly outwardly from the ninth portion 76 of the hour hand 34 and forms a ninth plane therewith.

The hour hand 34 further comprises an eleventh portion 80 that extends perpendicularly inwardly from the tenth portion 78 of the hour hand 34 and forms a tenth plane therewith.

The hour hand 34 further comprises a twelfth portion 82 that extends perpendicularly downwardly inwardly from the eleventh portion 80 of the hour hand 34 and forms an eleventh plane therewith, to the hour arbor 54 of the hour apparatus 28.

The first portion 60 of the hour hand 34, the fourth portion 66 of the hour hand 34, the seventh portion 72 of the hour hand 34, and the tenth portion 78 of the hour hand 34 are parallel to each other.

The second portion 62 of the hour hand 34, the fifth portion 68 of the hour hand 34, the eighth portion 74 of the hour hand 34, and the eleventh portion 80 of the hour hand 34 are parallel to each other.

The third portion 64 of the hour hand 34, the sixth portion 70 of the hour hand 34, the ninth portion 76 of the hour hand 34, and the twelfth portion 82 of the hour hand 34 are parallel to each other.

The first plane of the hour hand 34, the fourth plane of the hour hand 34, the seventh plane of the hour hand 34, and the tenth plane of the hour hand 34 are parallel to each other.

The second plane of the hour hand 34, the fifth plane of the hour hand 34, the eighth plane of the hour hand 34, and the eleventh plane of the hour hand 34 are parallel to each other.

The third plane of the hour hand 34, the sixth plane of the hour hand 34, and the ninth plane of the hour hand 34 are parallel to each other.

The hour hand 34 further has a red dot 84 that is disposed thereon where the tenth portion 78 of the hour hand 34 and the eleventh portion 80 of the hour hand 34 meet and provides an hour indicator.

The minute hand 30 extends upwardly from the minute arbor 56 of the minute apparatus 32, and is identical to, but smaller than so as to allow it to fit in, the hour hand 34.

The second hand 26 extends upwardly from the second arbor 58 of the second apparatus 28, and is identical to, but smaller than so as to allow it to fit in, the minute hand 30, with the red dots of each of the hour hand 34, the minute hand 30, and the second hand 26 exhibiting the different configuration at each time change when viewed from the same elevation, and by memorizing the different configurations, the viewer can tell the time without having to consult the clock face 24.

It will be understood that each of the elements described above, or two or more together, may also find a useful application in other types of constructions differing from the types described above.

While the invention has been illustrated and described as embodied in a clock with novelty hands, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A clock with novelty hands that exhibit a different configuration at each time change when viewed from a same elevation, and by memorizing said different configurations, a viewer can tell time without having to consult its clock face, said clock comprising:

a) a base;

b) a clock face disposed on said base;

c) a second hand rotatable mounted to said base;

d) second apparatus rotatably mounting said second hand to said base;

e) a minute hand rotatably mounted to said base;

f) minute apparatus rotatably mounting said minute hand to said base;

g) a hour hand rotatable mounted to said base;

h) hour apparatus rotatable mounting said hour hand to said base; and i) a bell jar replaceably mounted to said base and encapsulating said clock face, said second hand, said minute hand, and said hour hand, wherein said base is low and octagonally-shaped in plan view, and has a center, and an uppermost face that flares dependingly to a lowermost face that is below, and parallel to, said uppermost face of said base for resting on a horizontal surface, wherein said lowermost face of said base has a chamber that opens therein and extends upwardly therefrom to slightly below said uppermost of said base, and terminates in a throughbore that extends coaxially upwardly to, and opens into, said uppermost face of said base, at said center of said base, wherein said second apparatus, said minute apparatus, and said hour apparatus comprise a battery operated clock mechanism that is housed in said chamber in said base, wherein said hour apparatus further comprises a hour arbor that is operatively connected to said battery operated clock mechanism, and extends upwardly therefrom, through said throughbore of said chamber in said base, to said hour hand, wherein said hour hand is a slender and elongated rod bent into a specific configuration, wherein said hour hand comprises a first portion that inclines outwardly upwardly, at a 45 degree angle, from said hour arbor of said hour apparatus, wherein said hour hand further comprises a second portion that extends perpendicularly outwardly from said first portion of said hour hand and forms a first plane therewith, wherein said hour hand further comprises a third portion that inclines perpendicularly inwardly upwardly from said second portion of said hour hand and forms a second plane therewith.

2. The clock as defined in claim 1, wherein said chamber in said lowermost face of said base and said throughbore of said chamber in said base house said second apparatus, said minute apparatus, and said hour apparatus.

3. The clock as defined in claim 1, wherein said uppermost face of said base has an annular groove that extends completely and concentrically therearound, and defines said clock face.

4. The clock as defined in claim 1, wherein said clock face is disposed concentrically on said uppermost face of said base, and comprises numerals 1–12 in a circular pattern therearound.

5. The clock as defined in claim 1, wherein said second hand is specifically-configured and extends rotatably axially upwardly from said throughbore of said chamber in said base, with said second apparatus being operatively connected to said second hand.

6. The clock as defined in claim 1, wherein said minute hand is specifically-configured and extends rotatably axially upwardly from said throughbore of said chamber in said base, concentrically outward of said second hand, with said minute apparatus being operatively connected to said minute hand.

7. The clock as defined in claim 1, wherein said hour hand is specifically-configured and extends rotatably axially upwardly from said throughbore of said chamber in said base, concentrically outward of said minute hand, with said hour apparatus being operatively connected to said hour hand.

8. The clock as defined in claim 3, wherein said bell jar is transparent and replaceably engaged in said annular groove in said uppermost face of said base.

9. The clock as defined in claim 1, wherein said minute apparatus further comprises a minute arbor that is operatively connected to said battery operated clock mechanism, and extends upwardly therefrom, through said throughbore of said chamber in said base, and concentrically through, so as not to interfere with, said hour arbor of said hour apparatus.

10. The clock as defined in claim 9, wherein said second apparatus further comprises a second arbor that is operatively connected to said battery operated clock mechanism, and extends upwardly therefrom, through said throughbore of said chamber in said base, and concentrically through, so as not to interfere with, said minute arbor of said minute apparatus.

11. The clock as defined in claim 1, wherein said hour hand further comprises a fourth portion that inclines perpendicularly outwardly upwardly from said third portion of said hour hand and forms a third plane therewith.

12. The clock as defined in claim 11, wherein said hour hand further comprises a fifth portion that extends perpendicularly inwardly from said fourth portion of said hour hand and forms a fourth plane therewith.

13. The clock as defined in claim 12, wherein said hour hand further comprises a sixth portion that inclines perpendicularly inwardly upwardly from said fifth portion of said hour hand and forms a fifth plane therewith.

14. The clock as defined in claim 13, wherein said hour hand further comprises a seventh portion that inclines perpendicularly outwardly downwardly from said sixth portion of said hour hand and forms a sixth plane therewith.

15. The clock as defined in claim 14, wherein said hour hand further comprises an eighth portion that extends perpendicularly outwardly from said seventh portion of said hour hand and forms a seventh plane therewith.

16. The clock as defined in claim 15, wherein said hour hand further comprises a ninth portion that inclines perpendicularly inwardly downwardly from said eighth portion of said hour hand and forms an eighth plane therewith.

17. The clock as defined in claim 16, wherein said hour hand further comprises a tenth portion that inclines perpendicularly downwardly outwardly from said ninth portion of said hour hand and forms a ninth plane therewith.

18. The clock as defined in claim 17, wherein said hour hand further comprises an eleventh portion that extends perpendicularly inwardly from said tenth portion of said hour hand and forms a tenth plane therewith.

19. The clock as defined in claim 18, wherein said hour hand further comprises a twelfth portion that extends perpendicularly downwardly inwardly from said eleventh portion of said hour hand and forms an eleventh plane therewith, to said hour arbor of said hour apparatus.

20. The clock as defined in claim 17, wherein said first portion of said hour hand, said fourth portion of said hour hand, said seventh portion of said hour hand, and said tenth portion of said hour hand are parallel to each other.

21. The clock as defined in claim 18, wherein said second portion of said hour hand, said fifth portion of said hour hand, said eighth portion of said hour hand, and said eleventh portion of said hour hand are parallel to each other.

22. The clock as defined in claim 19, wherein said third portion of said hour hand, said sixth portion of said hour hand, said ninth portion of said hour hand, and said twelfth portion of said hour hand are parallel to each other.

23. The clock as defined in claim 18, wherein said first plane of said hour hand, said fourth plane of said hour hand, said seventh plane of said hour hand, and said tenth plane of said hour hand are parallel to each other.

24. The clock as defined in claim 19, wherein said second plane of said hour hand, said fifth plane of said hour hand, said eighth plane of said hour hand, and said eleventh plane of said hour hand are parallel to each other.

25. The clock as defined in claim 17, wherein said third plane of said hour hand, said sixth plane of said hour hand, and said ninth plane of said hour hand are parallel to each other.

26. The clock as defined in claim 18, wherein said hour hand further has a red dot that is disposed thereon where said tenth portion of said hour hand and said eleventh portion of said hour hand meet and provides an hour indicator.

27. The clock as defined in claim 26, wherein said minute hand extends upwardly from said minute arbor of said minute apparatus, and is identical to, but smaller than so as to allow it to fit in, said hour hand.

28. The clock as defined in claim 27, wherein said second hand extends upwardly from said second arbor of said second apparatus, and is identical to, but smaller than so as to allow it to fit in, said minute hand, with said red dots of each of said hour hand, said minute hand, and said second hand exhibiting said different configuration at each time change when viewed from said same elevation, and by memorizing said different configurations, said viewer can tell the time without having to consult said clock face.

29. A clock with novelty hands that exhibit a different configuration at each time change when viewed from a same elevation, and by memorizing said different configurations, a viewer can tell time without having to consult its clock face, said clock comprising:

a) a base;

b) a clock face disposed on said base;

c) a second hand rotatably mounted to said base;

d) second apparatus rotatable mounting said second hand to said base;

e) a minute hand rotatably mounted to said base;

f) minute apparatus rotatable mounting said minute hand to said base;

g) a hour hand rotatably mounted to said base;

h) hour apparatus rotatably mounting said hour hand to said base; and i) a bell jar replaceably mounted to said base and encapsulating said clock face, said second hand, said minute hand, and said hour hand, wherein said hour hand when viewed in plan, replicates a swastika.

30. A clock with novelty hands that exhibit a different configuration at each time change when viewed from a same elevation, and by memorizing said different configurations, a viewer can tell time without having to consult its clock face, said clock comprising:

a) a base;

b) a clock face disposed on said base;

c) a second hand rotatable mounted to said base;

d) second apparatus rotatably mounting said second hand to said base;

e) a minute hand rotatably mounted to said base;

f) minute apparatus rotatably mounting said minute hand to said base;

g) a hour hand rotatably mounted to said base;

h) hour apparatus rotatably mounting said hour hand to said base; and i) a bell jar replaceably mounted to said base and encapsulating said clock face, said second hand, said minute hand, and said hour hand, wherein said hour hand when viewed at a specific elevation, replicates a hexagram.

* * * * *